US009352338B2

(12) United States Patent
Reiff et al.

(10) Patent No.: US 9,352,338 B2
(45) Date of Patent: May 31, 2016

(54) CENTRIFUGAL SEPARATOR WITH A CASING SEALING ARRANGEMENT

(75) Inventors: Henrik Reiff, Farum (DK); Bent Madsen, Gentofte (DK)

(73) Assignee: Alfa Laval Corporate AB, Lund (SE)

( * ) Notice: Subject to any disclaimer, the term of this patent is extended or adjusted under 35 U.S.C. 154(b) by 251 days.

(21) Appl. No.: 13/884,813

(22) PCT Filed: Nov. 14, 2011

(86) PCT No.: PCT/DK2011/050435

§ 371 (c)(1),
(2), (4) Date: Jul. 23, 2013

(87) PCT Pub. No.: WO2012/062336

PCT Pub. Date: May 18, 2012

(65) Prior Publication Data

US 2014/0148326 A1 May 29, 2014

(30) Foreign Application Priority Data

Nov. 12, 2010 (DK) ..... 2010 70482

(51) Int. Cl.

| | |
|---|---|
| ***B04B 11/00*** | (2006.01) |
| ***B04B 7/02*** | (2006.01) |
| ***B04B 1/20*** | (2006.01) |
| ***B04B 11/02*** | (2006.01) |

(52) U.S. Cl.
CPC . *B04B 11/00* (2013.01); *B04B 1/20* (2013.01); *B04B 7/02* (2013.01); *B04B 11/02* (2013.01); *B04B 2001/2083* (2013.01)

(58) Field of Classification Search
CPC ..... B04B 7/02; B04B 7/04; B04B 11/00; B04B 11/02; B04B 1/20; B04B 2001/2083
USPC ..... 494/41, 56, 57, 58, 60
See application file for complete search history.

(56) References Cited

U.S. PATENT DOCUMENTS 2,614,748 A 10/1952 Ritsch
3,580,492 A * 5/1971 Schnittger et al. ..... 494/53

(Continued)

FOREIGN PATENT DOCUMENTS

CN 201510939 U 6/2010
DE 2166909 A1 2/1977

(Continued)

OTHER PUBLICATIONS

International Search Report issued in PCT Application No. PCT/DK2011/05435 mailed on Jul. 19, 2012.

(Continued)

*Primary Examiner* — Charles Cooley
*Assistant Examiner* — Shuyi Liu
(74) *Attorney, Agent, or Firm* — MKG, LLC

(57) ABSTRACT

A centrifugal separator for liquids with two phases of different density includes a bowl with a base defining a first rear area in a casing. At least two outlet passages extend through the base. A first outlet passages communicates with a first outlet opening discharging liquid in the first rear area, and the second outlet passages communicates with a second outlet opening discharging liquid in a second rear area rear of said first rear area. A flange attached to the bowl and a partition of the casing with an annular sealing in between separates the first and the second rear area.

7 Claims, 8 Drawing Sheets

(56) References Cited

U.S. PATENT DOCUMENTS

| | | | |
|---|---|---|---|
| 4,615,690 | A | 10/1986 | Ecker |
| 5,257,968 | A | 11/1993 | Caldwell |
| 7,022,061 | B2 | 4/2006 | Leung et al. |
| 8,444,541 | B2 | 5/2013 | Horbach et al. |
| 8,485,959 | B2 | 7/2013 | Madsen et al. |
| 2004/0058796 | A1 | 3/2004 | Feldkamp et al. |
| 2004/0072668 | A1 | 4/2004 | Leung |
| 2010/0273628 | A1 | 10/2010 | Onodera et al. |

FOREIGN PATENT DOCUMENTS

| | | | | | |
|---|---|---|---|---|---|
| DE | 263186 | A3 | | 12/1988 | |
| EP | 0574364 | A1 | | 12/1993 | |
| EP | 1480754 | A1 | | 12/2004 | |
| EP | 1480754 | B1 | | 12/2004 | |
| EP | 1480754 | B1 | | 4/2010 | |
| FR | 2120537 | | | 8/1972 | |
| JP | H1190273 | A | | 4/1999 | |
| JP | 2001-314779 | A | | 11/2001 | |
| JP | 2005074375 | A | * | 3/2005 | ..... B04B 1/20 |
| JP | 2010525945 | A | | 7/2010 | |
| KR | 1020100036238 | A | | 4/2010 | |
| KR | 1020100112563 | A | | 10/2010 | |
| SU | 822905 | A1 | | 4/1981 | |
| SU | 1071212 | A3 | | 1/1984 | |
| WO | 03074185 | A1 | | 9/2003 | |
| WO | WO 2008138345 | A1 | * | 11/2008 | ..... B04B 1/20 |
| WO | WO 2009072209 | A1 | * | 6/2009 | |
| WO | 2009127212 | A1 | | 10/2009 | |
| WO | 2010019418 | A2 | | 2/2010 | |

OTHER PUBLICATIONS

Machine translation of FR 2,120,537 retrieved from Espacenet Patent Search on May 10, 2013.

Office Action from corresponding Chinese Patent Application No. 201180054401.X, dated Nov. 5, 2013.

Office Action from corresponding Japanese Patent Application No. 2013-538074, dated Nov. 4, 2014.

Office Action from corresponding Korean Patent Application No. 10-2013-7014974.

Search Report for corresponding Danish Patent Application No. PA 201070482, date of completion Jun. 16, 2011.

Decision on Grant for Russian Patent Application No. 2013126685/05(039585), dated Aug. 4, 2014.

Second Office Action for Danish Patent Application No. PA201070482, dated Jul. 2, 2015, pp. 1-3.

* cited by examiner

CENTRIFUGAL SEPARATOR WITH A CASING SEALING ARRANGEMENT

FIELD OF THE INVENTION

The present invention relates to a centrifugal separator, in particular, a decanter centrifuge, for separating two phases of liquid of different density. The centrifugal separator includes a body configured to rotate in use in a direction of rotation around a horizontal axis of rotation. The axis of rotation extends in a longitudinal direction of the rotating body. A radial direction extends perpendicular to the longitudinal direction. The body includes a bowl. The bowl defines a base provided at a rear longitudinal end of the bowl. The base defines a first rear longitudinal area of the centrifugal separator rear of the base. At least two outlet passages extend through the base. The outlet passages communicating with respective weir edges at respective levels. The weir edges define a level of liquid in the bowl and a level of an interface between the two phases of liquid in the bowl during use of the centrifugal separator. A first of the outlet passages extend axially to a first outlet opening for discharging liquid from the rotating body in the first rear longitudinal area during use of the centrifugal separator. A second of the outlet passages includes a conduit extending to a second outlet opening discharging liquid from the rotating body in a second rear longitudinal area rear of said first rear longitudinal area during use of the centrifugal separator. The second outlet opening is positioned to have a distal edge relative to the axis of rotation placed at a level not above the level of the weir edge communicating with the second outlet opening.

BACKGROUND OF THE INVENTION

FR-A-2 120 537 discloses a centrifuge of the prior art.

EP-A-1 480 754 discloses an centrifugal separator in which the base comprises an inner annular space receiving in use a light phase of liquid that has passed the weir of the first outlet passage, from which annular space the liquid, in one embodiment (FIG. 2), is conveyed by a skimming disc to a central duct provided around an inflow pipe of the centrifugal separator. In another embodiment (FIG. 3) the inner annular space is connected with a passage extending radially an outlet opening discharging the liquid from the rotating body. In both embodiments the second outlet passage comprises a weir at an internal side of the base and the second outlet passage extends in a diverging manner relative to the axis of rotation to an outlet opening in the external side of the base, where an adjustable throttle device is provided for controlling the run-off quantity of a heavy phase of liquid.

WO-A-2009/127212, enclosed herein by reference, discloses a centrifugal separator having a base with two outlet passages for a light and a heavy phase of liquid, respectively, whereby one outlet passage extends axially through the base whereas the other outlet passage extends, via an outlet chamber inside the base, radially out of the base to a nozzle directing the out-flowing liquid in a direction opposite the direction of rotation.

It is an object of the present invention to provide a centrifugal separator of the art mentioned by way of introduction, in which both the heavy and the light phase is discharged from the rotating body at a relatively small radius or distance from the axis of rotation in order to reduce the energy consumption of the centrifugal separator.

It should be understood that the expression "level" refers to the radial distance from the axis of rotation, and by analogy to the field of gravity of earth "up" refers to a direction towards the axis of rotation and "down" refers to an opposite direction.

SUMMARY OF THE INVENTION

According to aspects disclosed herein there is provided centrifugal separators having a shaft part of a body configured to rotate about an axis of rotating the shaft part extends coaxially with the axis of rotation from a base. The shaft part carries a flange. A conduit extends from the base and through the flange to a second outlet opening. The flange separates the first and the second rear longitudinal area. The flange facilitates preventing re-mixing of the two phases after discharge from the respective outlet openings, and the flange may assist supporting the conduit.

Further according to the invention the centrifugal separator comprises a casing housing the body. The casing comprises a proximal compartment for receiving a liquid discharged from the body though the first outlet opening. The casing includes a distal compartment for receiving liquid discharged from the body through the second outlet opening. The proximal and distal compartments are separated by a partition. Thus the proximal compartment extends the first rear longitudinal area and the distal compartment extends the second rear longitudinal area. Thereby preventing the re-mixing of the two liquid phases. The casing including the partition is divided in at least two parts comprising a lid, whereby the above mentioned flange is surrounded by an annular seal and the partition engages the annular seal, at least when the lid is in a closed position, thereby preventing of re-mixing of the two liquid phases.

In one embodiment the distal edge constitutes the weir edge communicating with the second outlet opening.

In one embodiment the annular seal comprises an inner annular sealing member in sliding engagement with the flange and an outer flexible member providing for a non sliding engagement with the partition when the lid is in a closed position.

In another embodiment the annular seal comprises two semicircular parts attached to either of the two parts of the partition, the semicircular parts being securely mounted to the respective parts of the partition, to form an annular seal when the two parts of the casing and thus the two parts of the partition are brought together by bringing the lid into its closed position.

In one embodiment an outlet housing is placed in the second rear longitudinal area. The outlet housing constitutes part of the conduit. The outlet housing is rotatable around an adjustment axis, and the outlet housing includes a side wall offset from the adjustment axis. The second outlet opening is placed in the side wall. In one embodiment the conduit with the outlet housing is part of an outlet element having a connecting piece rotatably connected to the base. In a further embodiment the outlet element is tubular and has a tube axis coaxial with the adjustment axis. In one embodiment the adjustment axis is parallel with the axis of rotation. By providing an outlet opening in a side wall of such rotatable outlet housing the liquid dischargable by the outlet opening in a direction opposite the direction of rotation, thereby recovering energy from the discharged liquid. Further, when the distal edge of the outlet opening provides the weir edge of the outlet passage in question, rotating the outlet housing will adjust the level of the weir edge.

Generally for cases where a seal between a rotating member such as a flange, e.g. of a rotating body comprising a bowl of the centrifuge (e.g. a decanter centrifuge) and a sectioned partition (e.g. a casing) is required, according to the present invention an annular seal comprises an inner annular sealing member in sliding engagement with the flange and an outer flexible member providing for a non sliding engagement with the partition when the sections thereof are brought together e.g. by bringing a lid carrying a section of the partition into a closed position.

In one embodiment at least one of the weir edges extend in a plane, which is parallel with the base.

BRIEF DESCRIPTION OF THE DRAWINGS

In the following the invention will be described in more detail by way of examples of embodiments with reference to the schematic drawing, in which.

DETAILED DESCRIPTION

Figure 1:
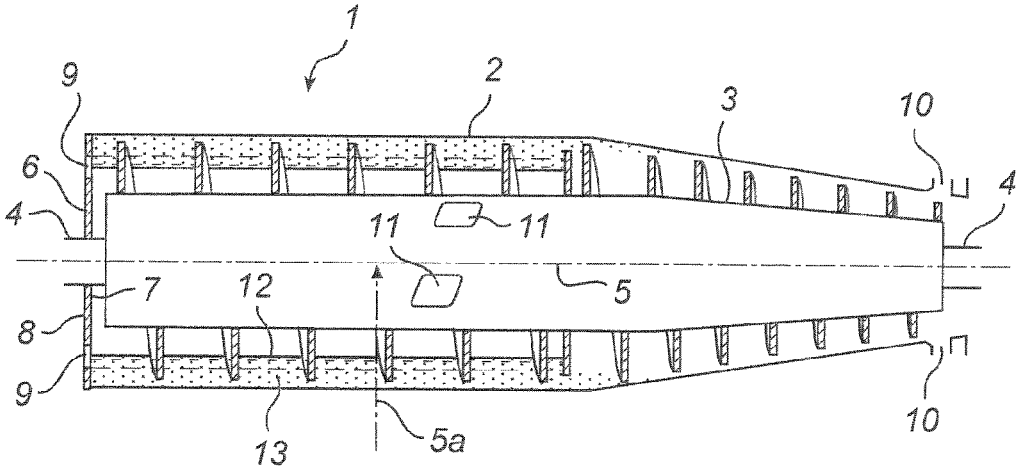
Fig. 1 Prior Art
FIG. 1 shows a longitudinal section of a rotating body of a prior art decanter centrifuge.

A rotatable body 1 of a prior art centrifugal separator or decanter centrifuge schematically shown in FIG. 1 includes a bowl 2 and a screw conveyor 3 which are mounted on a shaft 4 such that they are brought to rotate around a horizontal axis 5 of rotation during use of the centrifugal separator. The axis 5 of rotation extends in a longitudinal direction of the bowl 2. Further, the rotatable body 1 has a radial direction 5*a* extending perpendicular to the longitudinal direction.

For the sake of simplicity directions "up" and "down" are used herein as referring to a radial direction towards the axis 5 of rotation and away from the axis 5 of rotation, respectively.

The bowl 2 includes a base plate 6 provided at one longitudinal end of the bowl 2, which base plate 6 has an internal side 7 and an external side 8. The base plate 6 is provided with a number of liquid phase outlet passages 9 having external openings in the external side 8 of the base plate. Furthermore the bowl 2 is at an end opposite to the base plate 6 provided with solid phase discharge openings 10.

The screw conveyor 3 comprises inlet openings 11 for feeding a feed e.g. slurry to the rotatable body 1. The slurry includes a light or liquid phase 12 and a heavy or solid phase 13. During rotation of the rotatable body 1 as previously described, separation of the liquid phase 12 and solid phase 13 phases is obtained. The liquid phase 12 is discharged through the outlet passages 9 in the base plate 6, while the screw conveyor 3 transports the solid phase 13 towards the solid phase discharge openings 10 through which the solid phase 13 is eventually discharged.

Figure 2:
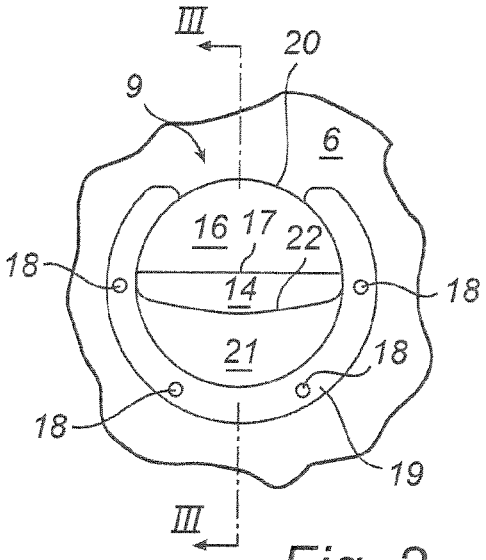
Fig. 2 Prior Art
FIG. 2 shows an outlet of a prior art decanter centrifuge.

With reference to FIG. 2 the external opening of each liquid phase outlet passage 9 may according to the prior art be partly covered by a weir plate 14. The weir plate 14 determines the level 15 of liquid (see FIG. 3) in the bowl which substantially cannot exceed the overflow edge 17 of the weir plate, because the area 16 of the opening above the weir plate 14 from a practical view of the liquid is unlimited. The weir plate 14 is securely fixed to the base plate 6 by fastening means (not shown) in the form of fasteners, for example bolts protruding through holes 18 in a peripheral part 19 of a supporting device 21. In the fixed state the peripheral part 19 covers at least part of the rim 20 of external opening of the liquid phase outlet passage 9, and the supporting device 21 partly covers the weir plate 14 to a level indicated by 22 on FIG. 2.

Figure 3:
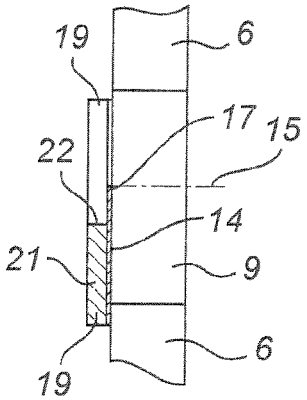
Fig. 3 Prior Art
FIG. 3 shows a section along line III-III in FIG. 2.

FIG. 3 shows a cross section through the liquid phase outlet opening 9 along the line III-III in FIG. 2, indicating the level 15 of liquid, which substantially coincides with the overflow edge 17 of the weir plate 14.

Figure 4:
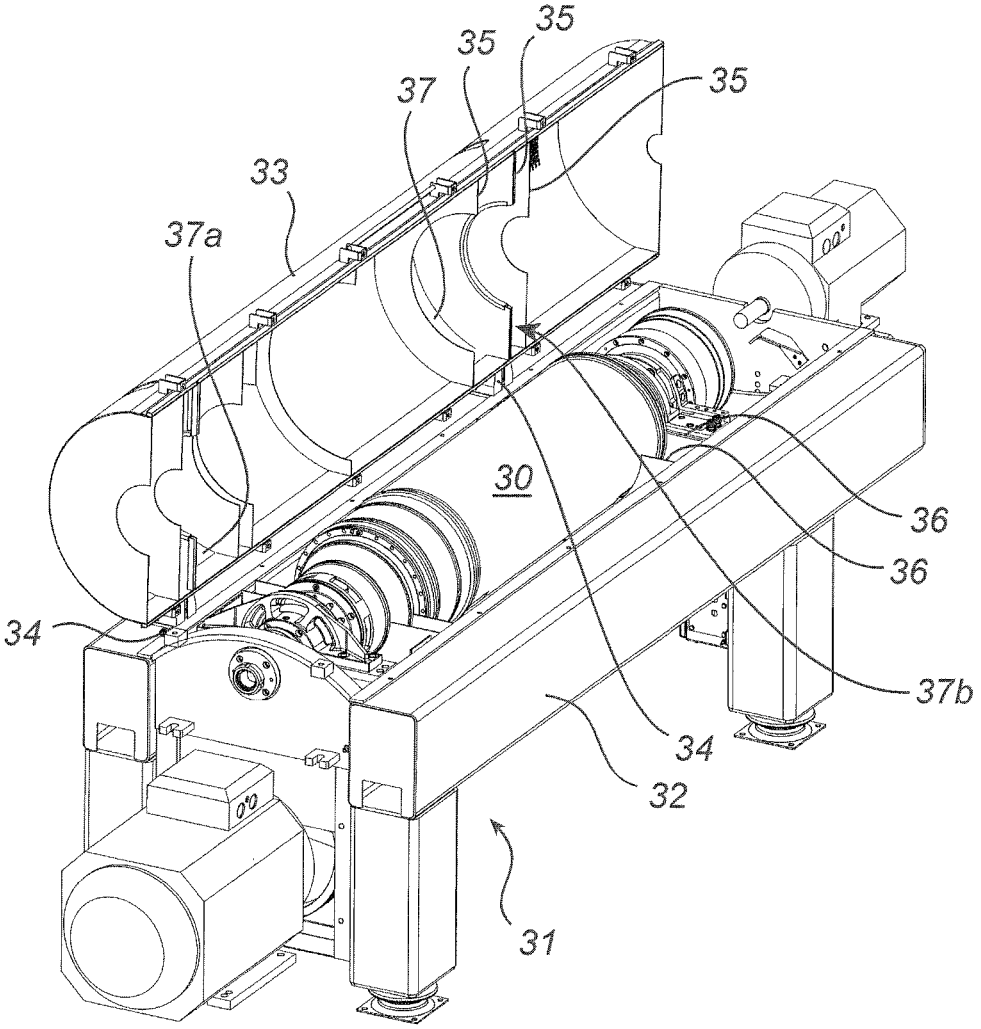
Fig. 4 Prior Art
FIG. 4 shows a prior art decanter centrifuge with an open lid.

FIG. 4 shows for illustration a prior art decanter centrifuge comprising a rotatable body 30 mounted in a casing 31 comprising a lower part 32 and a lid 33 hinged to the lower part 32 by means of hinges 34. The lid is shown in an open position. The casing comprises several partitions, which are sectioned whereby upper semicircular sections 35 of the partitions are attached to the lid 33 to cooperate with lower sections 36 of the partitions in the lower part 32 of the casing when the lid is brought into a closed position. These partitions divide the space between inner walls of the casing 31 and the rotatable body 30 into compartments 37, some of which are used for collecting respective phases of the feed separated inside the rotatable body 30. Thus a heavy phase compartment 37*a* collects a heavy solid phase and a light phase compartment 37*b* collects a light liquid phase.

Figure 5:
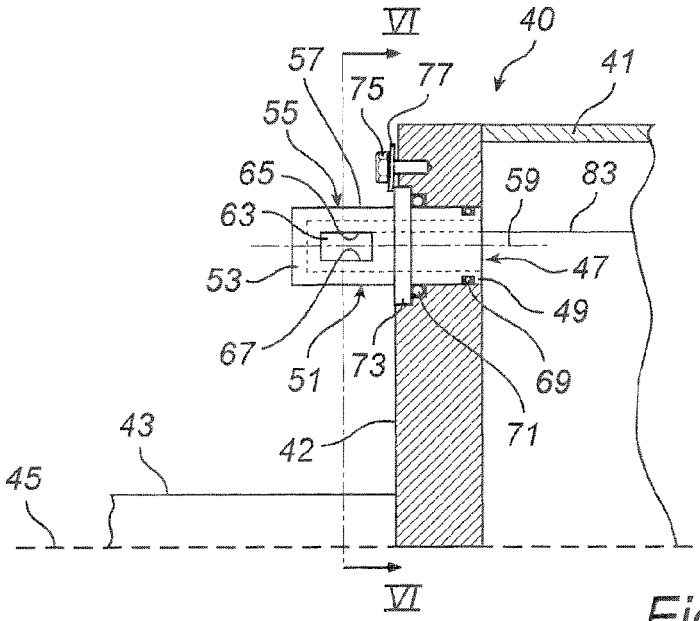
FIG. 5 shows a partial longitudinal section of an embodiment of an outlet arrangement usable with the present invention.
Figure 6:
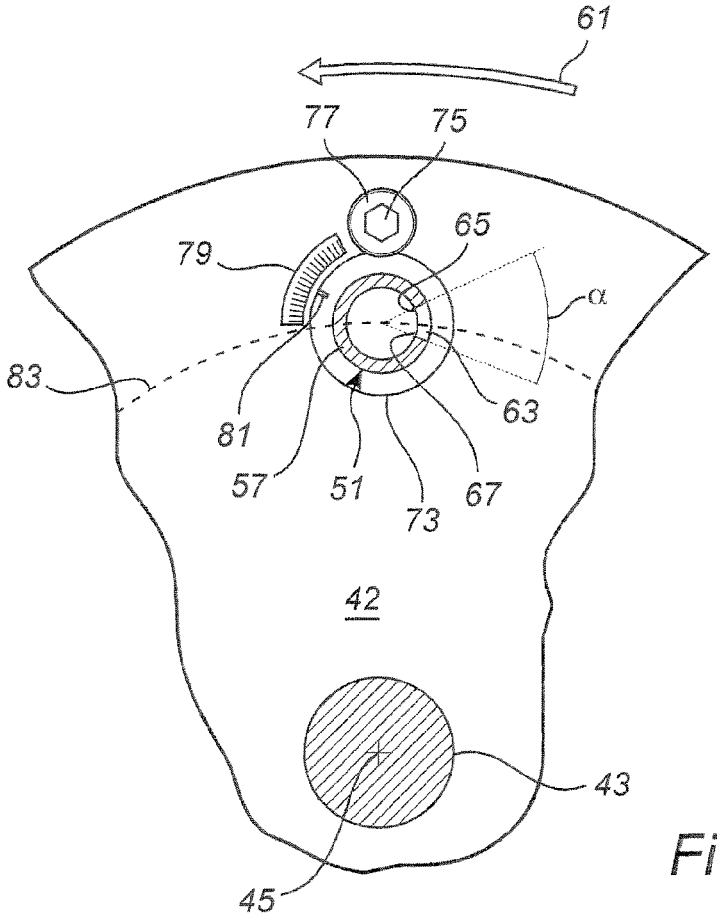
FIG. 6 shows a section along line VI-VI in FIG. 5.

FIGS. 5 and 6 illustrates part of a rotatable body 40 comprising a bowl 41, a base plate or base 42, and a shaft part 43 connected to the base 42. The rotatable body has a horizontal axis of rotation 45. So far the rotatable body 40 may be similar to the rotating bodies 1 and 30 shown in FIGS. 1 and 4 respectively. However, to illustrate an outlet arrangement usable with the present invention, a liquid phase outlet passage 47 extending through the base 42 accommodates a circular connecting piece 49 of a tubular outlet element 51 with a blind end 53. The tubular outlet element 51 thus extends the outlet passage 47.

The blind end 53 provides an outlet housing 55 with a circular cylindrical side wall 57. The outlet element 51 has an axis extending in parallel to the axis of rotation 45 and constituting an adjustment axis 59 as it will be explained in more detail below. In operation the rotatable body 40 is rotating in a direction of rotation 61 as indicated in FIG. 6. The side wall 57 of the outlet housing 55 comprises an outlet opening 63 with a weir edge 65 and an opposite edge 67 both of which extend along a respective generator of the cylinder surface of the cylindrical side wall 57. The weir edge 65 and the opposite edge 67 extend between them an angle $\alpha$, which preferably is in the range 30° to 75°, more preferably 45° to 60°.

In the embodiment shown the connecting piece 49 is substantially cylindrical like the outlet housing 55 apart from a grove accommodating an O-ring seal 69. Another O-ring seal 71 is accommodated in a recess surrounding the outlet passage 47. The outlet element 51 comprises a circumferential collar 73, which is partly accommodated in another recess surrounding the outlet passage 47. Being circular the connecting piece 49, and therewith the rest of the outlet element 51, is rotatable around the adjustment axis 59.

A screw 75 with a washer 77 is provided beside the outlet element 51 so that tightening the screw 75 urges the washer 77 against the collar 73 thereby clamping the same, whereby rotation of the outlet element 51 is prevented, the screw 75 and the washer 77 constituting an embodiment of a fastener.

Further a scale 79 is provided on the surface of the base 42 beside the recess accommodating the collar 73, and on the collar a mark 81 is provided giving an indication of the angular position of the outlet element 51, the scale 79 and the mark 81 together constituting an embodiment of an indicator.

Though only one outlet passage 47 is shown in FIGS. 5 and 6 it should be understood that a plurality of outlet passages may be present and evenly distributed around the axis of rotation as it is normal for such centrifugal separators.

The outlet housing 55 works as follows:

In use the bowl 41 rotates in the direction 61 causing a feed inside the bowl 41 to separate in a heavy solid phase (not shown) and a light liquid phase having a surface at a level 83, which is slightly above the level of the weir edge 65 thereby providing a pressure head driving the liquid phase out of the bowl through the outlet element 51 and the outlet opening 63. The outlet opening 63 should be so large that during normal use of the centrifugal separator it does not run full, but a free space or an air vent between the free surface of the flowing liquid and the opposite edge 67 will be present.

The outlet element 55 is put in an angular position by rotating it around the adjustment axis 59 to bring the weir edge 65 to a desired level corresponding to a desired level 83 of the liquid inside the bowl. If the latter level need to be adjusted the level of the weir edge 65 is adjusted correspondingly by rotating the outlet element 55 around the adjustment axis 59. Due to the circular movement of the adjustment raising the weir edge 65 will at a given point entail that the opposite edge 67 is lowered to a position close to or below the level of the weir edge 65 and at that point liquid will flow over the opposite edge 67 which is not intended. Thus there is a limit to the range within which the level of the weir edge can be adjusted. The larger the angle $\alpha$ is, the smaller is the range within which the level of the weir edge can be adjusted while obtaining the intended function. However the smaller the angle $\alpha$ is the smaller is also the size of the outlet opening 63. These are factors the skilled person will take into consideration when deciding the size of the angle $\alpha$.

When adjusting the angular position of the outlet element 51 care is taken that the outlet opening 63, as shown in FIG. 6, is facing rearwards relative to the direction of rotation 61 in order to discharge the liquid phase in an opposite direction relative to the direction of rotation 61 whereby energy is recovered from the discharged liquid.

For adjustment of the angular position of the outlet element 51 the screw 75 is un-tightened to release the collar 73 from the clamping action of the washer 77. The outlet element is turned around the adjustment axis using the scale 79 and mark 81 to control the angle of adjustment, and the screw is tightened again to prevent unintended rotation of the outlet element 51.

Figure 7:
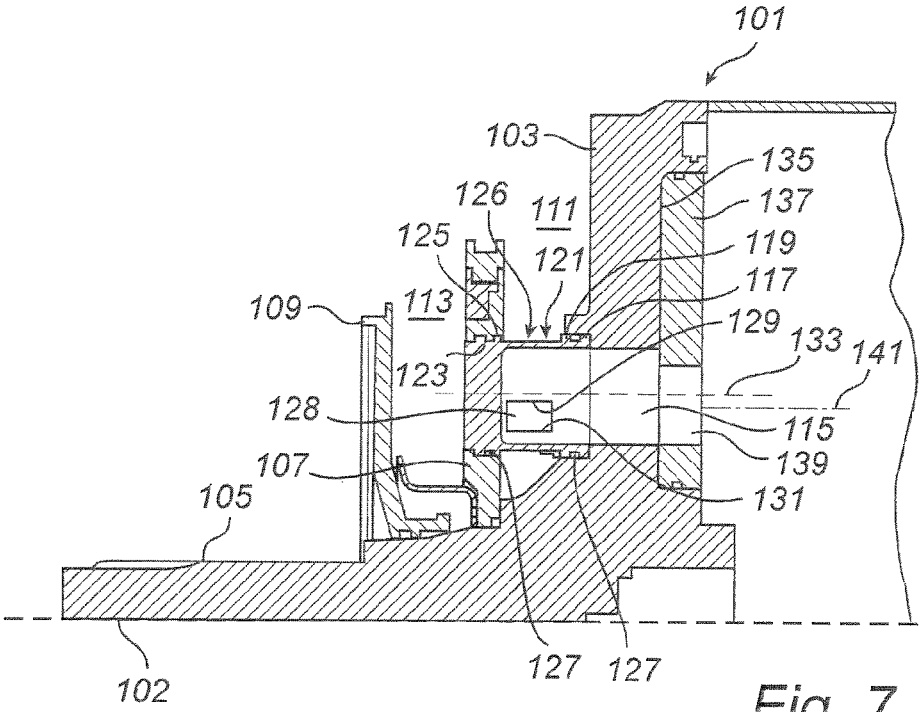
FIG. 7 shows a partial longitudinal section of a rotatable body according to the present invention showing a first outlet.
Figure 8:
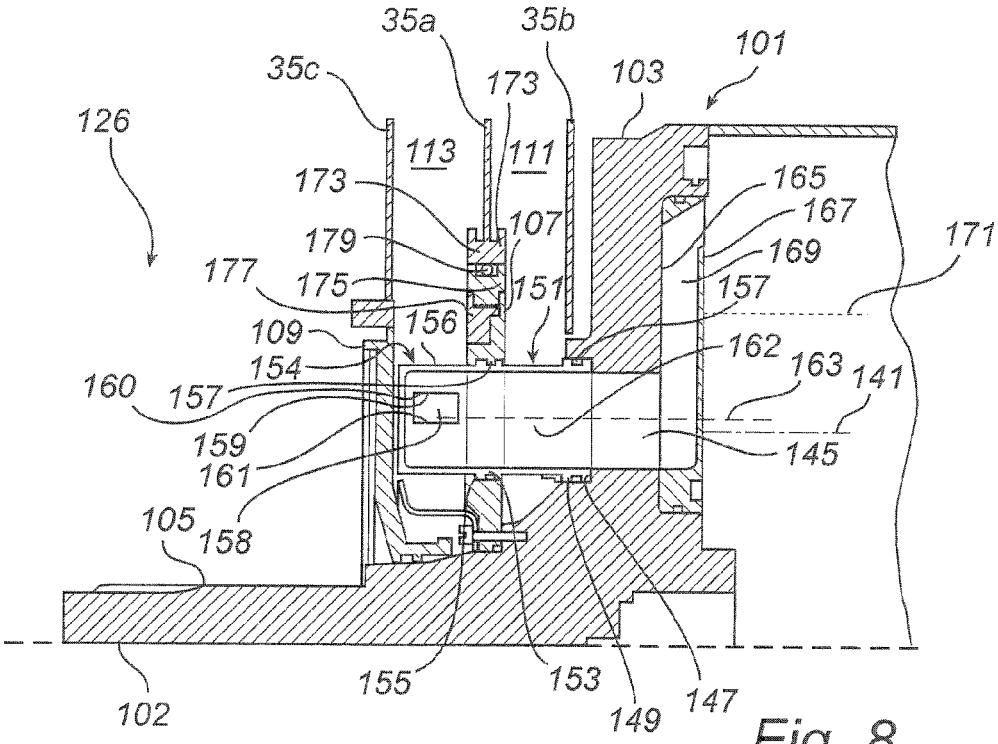
FIG. 8 shows a partial longitudinal section of the rotatable body of FIG. 7 showing a second outlet.
Figure 9:
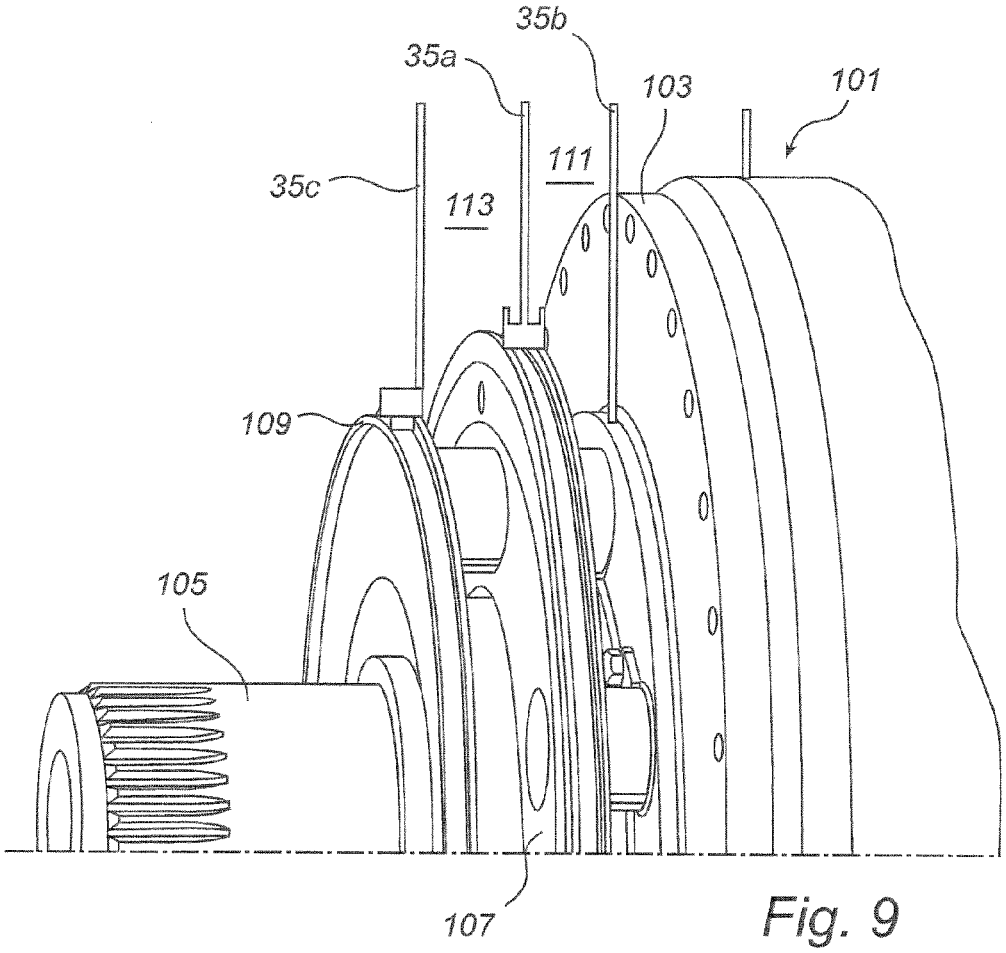
FIG. 9 shows a partial perspective view of the rotatable body in FIGS. 7 and 8.

FIGS. 7 to 9 show a part of an embodiment of a rotatable body 101 according to the invention. The parts not shown may be similar to corresponding parts of the embodiments shown in FIGS. 1 to 6. However the present embodiment is adapted for separating feeds wherein a liquid phase comprises a mixture of two liquid phases of different density. Thus elements the inside the bowl (not shown) may be similar to the elements inside the embodiments of a bowl disclosed in WO 2009/127212, which is incorporated herein by reference. The rotatable body 101 has an axis of rotation 102 and comprises a base 103, which is connected with a shaft part 105, which carries a flange 107, and a coaxial shield 109 is provided. The base 103 and the flange 107 define between them a first rear longitudinal area 111 of the centrifugal separator, and the flange 107 and the shield 109 define between them a second rear longitudinal area 113 of the centrifugal separator. By definition the first rear longitudinal area 111 is rear of the base 103, and the second rear longitudinal area 113 is rear of the first rear longitudinal area 111.

Partitions of a casing, which is not shown in detail, but which corresponds to the casing shown in FIG. 4, are indicated in FIGS. 8 and 9 by their upper sections 35*a*, 35*b* and 35*c*. Upper section 35*a* and the flange 107 defines together with upper section 35*b* a proximal compartment in the first rear longitudinal area 111, and upper section 35*a* and the flange 107 defines together with upper section 35*c* and the shield 109 a distal compartment in the second rear longitudinal area 113.

Being adapted for feeds comprising two liquid phases the base 103 comprises two outlet passages provided at different angular positions relative to the axis of rotation 102.

FIG. 7 shows a first outlet passage 115 with a recess 117 accommodating a connecting piece 119 of a first circular cylindrical outlet element 121 extending the first outlet passage. A blind end of the outlet element 121 is formed as a connecting piece 123 accommodated in an opening 125 in the flange 107. Thus the outlet element 121 is held by the base 103 and the flange 107. O-ring seals 127 are provided in respective grooves in the connecting pieces 119 and 123. The part of the outlet element 121 between the connecting pieces 119 and 123 constitutes a circular cylindrical side wall of an outlet housing 126 with a first outlet opening 128 having a first weir edge 129 and an opposite edge 131. The first outlet housing 126 is rotatable around an adjustment axis 133 as the connecting pieces 119 and 123 are circular. In an inner surface of the base a recess 135 is provided at the outlet passage 115. The recess 135 accommodates a channel member 137 with a through passage 139 opening into the outlet passage 115 thereby extending the latter.

During use the outlet housing 126 with its weir edge 129 works similar to the outlet housing 55 described with reference to FIGS. 5 and 6, the weir edge 129 defining a level 141 of liquid inside the bowl. Thus, in use the light phase of the liquid from the bowl will be discharged from the first outlet opening 128 into the proximal compartment in the first rear longitudinal area 111.

It should however be noted that the orientation of the outlet opening 128 indicates that the direction of rotation of the rotatable body in this embodiment is opposite to the direction of rotation of the rotatable body of the embodiment shown in FIGS. 5 and 6.

FIG. 8 shows a second outlet passage 145 with a recess 147 accommodating a connecting piece 149 of a second circular cylindrical outlet element 151 extending the second outlet passage. A blind end of the outlet element 151 is formed as a second outlet housing 154 with a circular cylindrical side wall 156, which comprises a second outlet opening 158 with a distal edge 160 distal from the axis of rotation 102 and an opposite edge 161 proximal the axis of rotation 102 both of which edges extend along a respective generator of the cylinder surface of the cylindrical side wall 156. In the present embodiment the distal edge 160 constitutes a second weir edge 159. The outlet element 151 is provided with an intermediate connecting piece 153 accommodated in an opening 155 with a recessed shoulder in the flange 107. Thus the outlet element 151 is held by the base 103 and the flange 107. O-ring seals 157 are provided in respective grooves in the connecting pieces 149 and 153. The part of the outlet element 151 between the connecting pieces 149 and 153 constitutes a tubular conduit 162. The second outlet housing 154 is rotatable around an adjustment axis 163 as the connecting pieces 149 and 153 are circular. In an inner surface of the base a recess 165 is provided at the second outlet passage 145. The recess 165 accommodates a second channel member 167 with a passage 169 extending the second outlet passage 145 to a lower level in the bowl, where a heavy liquid phase is present. Thus the second channel member 167 shields in use the second outlet passage 145 from the light liquid phase in the bowl.

In use the second outlet housing 154 with its weir edge 159 works similar to the outlet housing 55 described with reference to FIGS. 5 and 6 and similar to the outlet housing 126 described with reference to FIG. 7. However the weir edge 159 is not defining the level 141 of liquid inside the bowl, but is together with the first weir edge 129 defining the level 171 of an interface between given light and heavy liquid phases in the bowl. The skilled person will understand that the actual level 171 of said interface also depends on the rate between the densities of the light and the heavy phase. Thus, in use the heavy phase of the liquid from the bowl will be discharged from the second outlet opening 158 into the distal compartment in the second rear longitudinal area 113.

In one embodiment parts of a unitary element the second outlet housing 154 and the tubular conduit 162 constitute an elongate outlet housing having a first axial length and the second outlet opening 158 extends a second axial length, which is less than half the first axial length. Thereby the second outlet opening 158 is placed remote from the base 103. This provides for discharging one of the liquid phases in the second rear longitudinal area 113 next to the first rear longitudinal area 111, while discharging said liquid phase at a level close to the level of the liquid inside the bowl, which assists minimizing loss of energy. Discharging the liquid in a direction opposite the direction of rotation assists minimizing further the loss of energy or entails recovery of energy from the rotatable body of liquid in the bowl.

For adjustment of the levels 141 and 171 the first and the second outlet elements 121 and 151 are rotated around their respective adjustment axis 133 and 163 using indicators not shown to control the rotation and un-tightening fasteners not shown to allow the rotation. This is similar to the adjustment described with reference to the embodiment shown in FIGS. 5 and 6.

While in the embodiment shown in and discussed with reference to FIGS. 7 to 9, the light phase is discharged into the proximal compartment and the heavy phase is discharged into the distal compartment, this could be changed by interchanging the channel members 137 and 167 and by corresponding readjustment of the levels of the first and the second weir edge 129 and 159, whereby the heavy phase is discharged into the proximal compartment and the light phase is discharged into the distal compartment.

In order to prevent re-mixing of the two liquid phases after discharge from the respective outlet openings 128 and 158 a seal is provided between the flange 107 and a partition of the casing cooperating therewith. FIGS. 8 and 9 show an upper section 35*a* of the partition, which includes a foot portion 173. The flange 107 carries an inner annular sealing member 175 mounted by means of an annular holding element 177 attached to the flange 107. The annular sealing member 175 is in sliding engagement with the flange 107 and it is preferably made of a relative hard plastics material. The annular sealing member 175 has a groove accommodating an outer flexible member in the form of an O-ring seal 179. When the lid of the casing is in its closed position, as indicated in FIGS. 8 and 9 by the position of the upper section 35*a* of the partition, the foot portion 173 press against the O-ring seal 179 and prevents rotation of the annular sealing member 175 while the sliding engagement of the annular sealing member 175 with the flange 107 allows the rotatable body 101 to rotate. This sealing construction may also be used between other partitions and corresponding parts of the rotatable body.

It should be noted that while the embodiment shown in FIGS. 7 to 9 utilizes the outlet arrangement shown in FIGS. 5 and 6, it is within the scope of the present invention to omit the first and/or the second outlet housing 126 and 156 and instead e.g. provide weirs like the weir shown in FIGS. 2 and 3 to discharge one liquid phase from the first outlet passage 115 directly into the proximal compartment over the weir edge 17 and/or to discharge the other liquid phase from the tubular conduit 162 directly into the distal compartment e.g. over the weir edge 17.

Figure 10B:
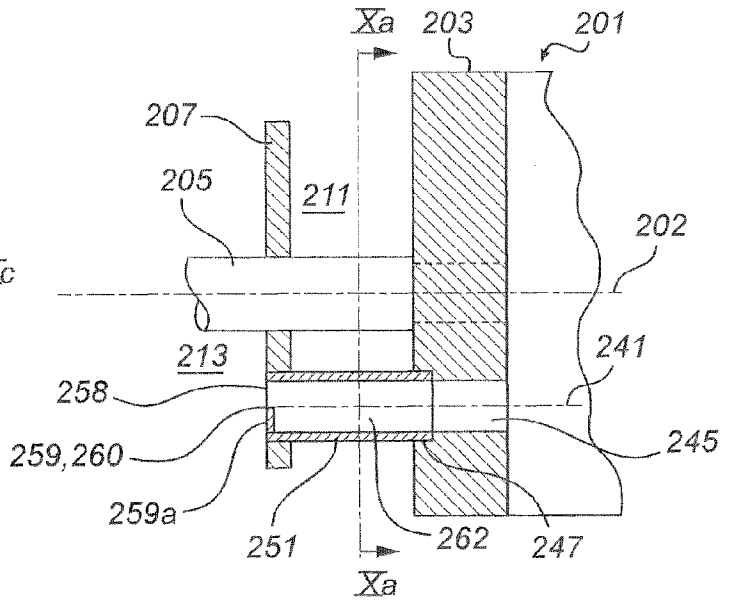
FIG. 10*b* shows a section along line Xb-Xb in FIG. 10*a*.
Figure 10A:
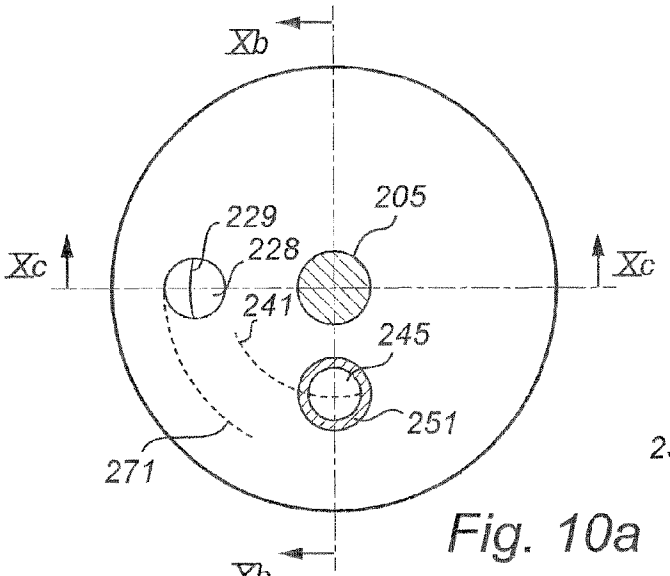
FIG. 10*a* shows an end view, as indicated by line Xa-Xa in FIG. 10*b*, of the base of a decanter centrifuge in a second embodiment
Figure 10C:
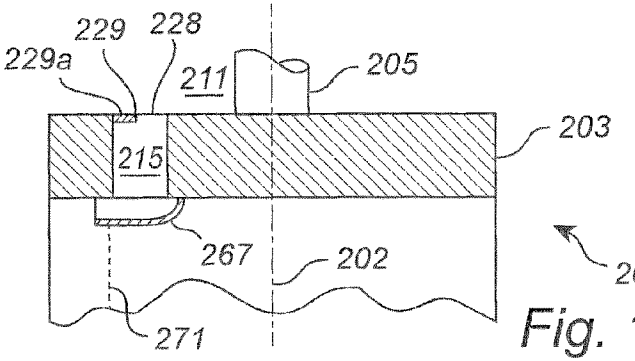
FIG. 10*c* shows a section along line Xc-Xc in FIG. 10*a*.

FIGS. 10*a*, 10*b* and 10*c* illustrates an embodiment with a rotatable body 201 having an axis of rotation 202 and comprising a base 203. A shaft part 205 is connected to the base 203 and carries a flange 207. A first outlet passage 215 extends through the base 203 to a first outlet opening 228, at which a first weir plate 229*a* with a first weir edge 229 is provided. At an inner surface of the base a shielding channel member 267 extends the first outlet passage 215 to a level in the bowl below an interface 271 between light and heavy liquid phase. Thus the shielding channel member 267 shields in use the first outlet passage 215 from the light liquid phase in the bowl of the rotatable body 201. Thus, in use the heavy phase of the liquid in the bowl will be discharged from the first outlet opening 228 into a proximal compartment in a first rear longitudinal area 211.

FIG. 10*b* shows a second outlet passage 245 with a recess 247 accommodating a connecting piece of an outlet element 251 extending through the flange 207 and providing a tubular conduit 262 extending the second outlet passage 245 to a second outlet opening 258 delimited by a second weir plate 259*a* with a second weir edge 259, which constitutes a distal edge 260 of the second outlet opening 258. The second weir edge 259 defines a level 241 of liquid inside the bowl. Thus, in use the light phase of the liquid from the bowl will be discharged from the second outlet opening 258 into a distal compartment in a second rear longitudinal area 213.

In this embodiment the weir plates 229*a* and 259*a*, and thus the weir edges 229 and 259, extends parallel to the base 203 and the flange 207, respectively, and further in this embodiment the base 203 and the flange 207 both extends in respective planes perpendicular to the axis of rotation 202.

Figure 11:
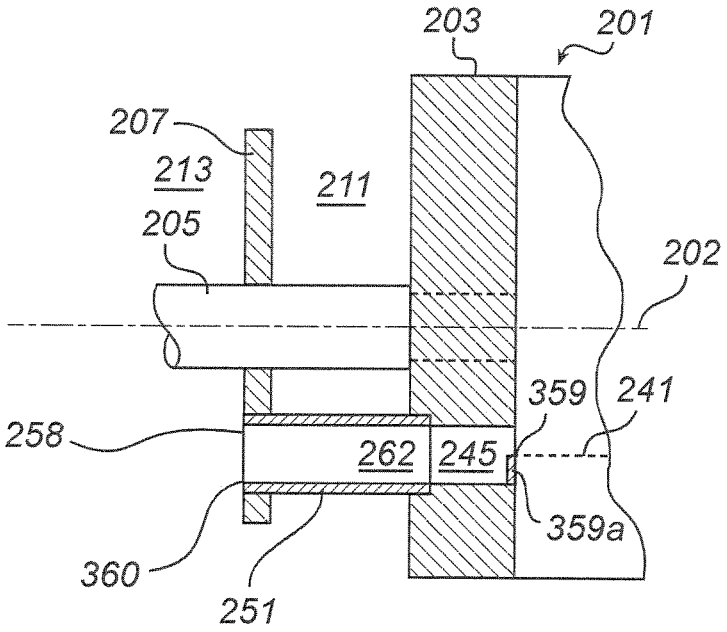
FIG. 11 shows a section corresponding to FIG. 10*b* of a variant of the embodiment shown in FIGS. 10*a*-10*c*.

FIG. 11 is a view corresponding to FIG. 10*b* of a variant of the embodiment shown in FIGS. 10*a*, 10*b*, and 10*c*. Thus identical elements are referred to by identical reference numerals. In the embodiment of FIG. 11 the weir plate comprising the weir edge communicating with the second outlet passage 245 has been removed from the second outlet opening 258. Instead a second weir plate 359*a* with a second weir edge 359 is provided to restrict the entrance of the second outlet passage 245 at the inner surface of the base. The second weir edge 359 defines the level 241 of liquid inside the bowl of the rotatable body 201. In this case the lower part of the second outlet opening 258 constitutes the distal edge 360 of said second outlet opening. Thereby the distal edge 360 is placed at a level below the level of the weir edge 359 allowing liquid that has passed the weir edge 359 to flow freely to the second outlet opening 258 and out therefrom into the distal compartment in the second rear longitudinal area 213, without a level of liquid flowing in the tubular conduit 262 extending above the weir edge 359, which would ruin the function of said weir edge 359 as a means for controlling the level 241 of liquid inside the bowl.

In one embodiment one of the outlets of the embodiments of FIGS. 10 and 11 would be provided with an outlet housing as described in relation to FIGS. 5 to 8.

Figure 12:
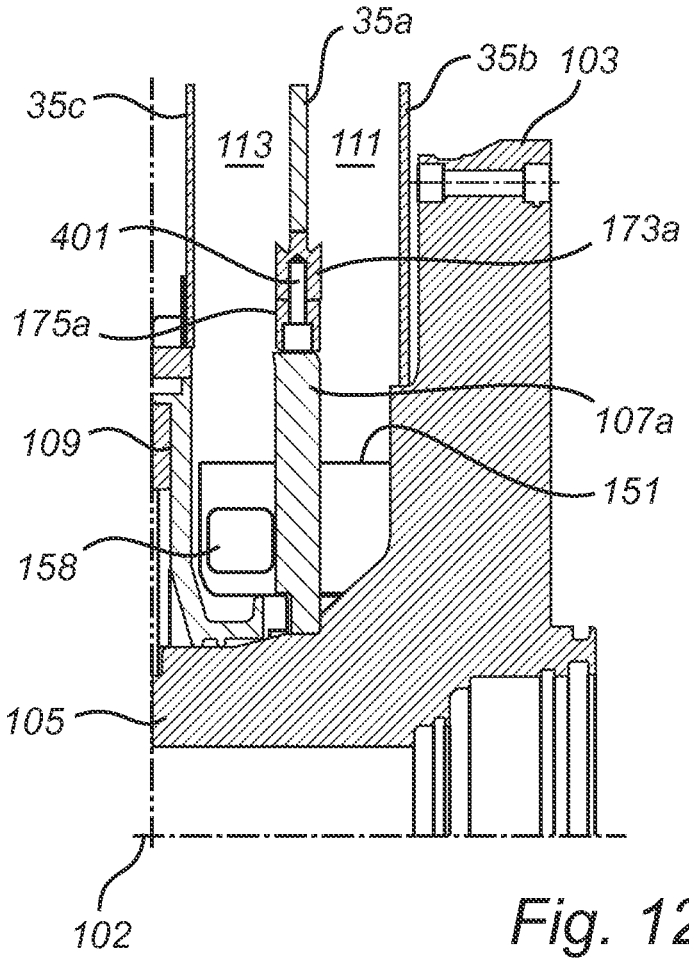
FIG. 12 shows, similar to FIG. 8, a partial longitudinal section of a rotating body and partitions of a casing.
Figure 13:
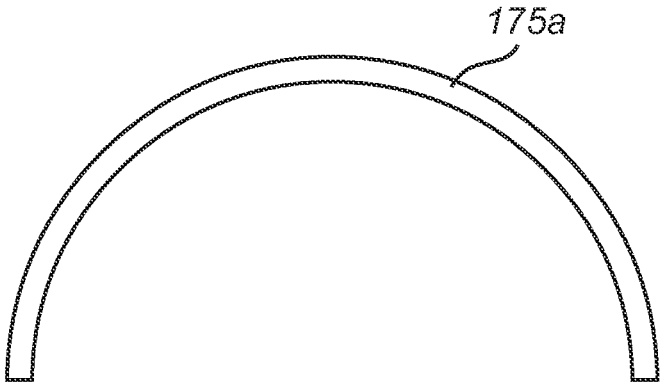
FIG. 13 is a plan view of a seal member.

FIGS. 12 and 13 illustrate another embodiment of an annular seal between a flange attached to a rotatable body and a partition. Elements that are or might be similar to elements shown in FIG. 8 are given the same reference numerals as used in FIG. 8.

FIG. 12 shows a part of a rotatable body comprising a base 103, a shaft part 105, an axis of rotation 102, a shield 109, a second circular outlet element 151 with a second outlet opening 158. The shaft part 105 carries a flange 107*a*, the second circular outlet element 151 extending through the flange 107*a*. FIG. 12 further shows upper sections 35*a*', 35*b* and 35*c* of partitions of a casing. It should be understood that the upper sections 35*a*', 35*b* and 35*c* are attached to a lid of the casing as shown in FIG. 4. The partition represented by the upper section 35*a*' and the flange 107*a* separate together the first rear longitudinal area 111 and the second rear longitudinal area 113.

The upper section 35*a*' has a foot portion 173*a*, which has a sufficient size to receive screws 401 (only one of which is shown) for mounting a semicircular sealing element 175*a*. FIG. 13 is a plan view of the semicircular sealing element 175*a* showing its shape at least in a mounted position. It should be understood that a similar semicircular sealing element 175*a* is mounted on a lower section corresponding to the upper section 35*a*' of the partition, said lower section being mounted in a lower part of the casing opposite the upper section 35*a*', which as mentioned is mounted in the lid of the casing.

One skilled in the relevant art will appreciate that in the embodiment of FIGS. 12 and 13 when the rotatable body is mounted in the casing as shown in FIG. 4 and the lid is closed the two semicircular sealing elements 175*a* will form a sectioned annular sealing, which is in sliding engagement with a circumferential surface of the flange 107*a* to perform a function similar to the function of the annular sealing member 175 shown in FIG. 8.

Although this invention has been shown and described with respect to the detailed embodiments thereof, it will be understood by those skilled in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

The invention claimed is:

1. A centrifugal separator for separating two phases of liquid of different density, comprising:

a rotating body rotating in use in a direction of rotation around an axis of rotation, said axis of rotation extending in a longitudinal direction of said rotating body, a radial direction extending perpendicular to the longitudinal direction;

said rotating body comprising a bowl, said bowl comprising a base provided at a rear longitudinal end of said bowl, said base facing a first rear longitudinal area of the centrifugal separator rear of said base, at least two outlet passages extending through said base, said outlet passages communicating with respective weir edges at respective levels, said weir edges defining in use a level of liquid in the bowl and a level of an interface between the two phases of liquid in the bowl, a first of said outlet passages extending axially to a first outlet opening discharging in use liquid from the rotating body in said first rear longitudinal area, and a second of said outlet passages comprising a conduit extending to a second outlet opening discharging in use liquid from the rotating body in a second rear longitudinal area rear of said first rear longitudinal area, said second outlet opening being positioned to have a distal edge relative to the axis of rotation placed at a level not above the level of the weir edge communicating with said second outlet opening, a shaft part of the rotating body extending coaxially with the axis of rotation from the base, said shaft part carrying a flange, and said conduit extends from the base and through the flange to said second outlet opening, the flange separating said first and said second rear longitudinal area, a casing housing the rotating body, said casing comprising a proximal compartment for receiving a liquid discharged from the rotating body through the first outlet opening, and a distal compartment for receiving liquid discharged from the rotating body through the second outlet opening, said compartments being separated by a partition, and wherein the casing including the partition is divided in at least two parts comprising a lid, the flange is surrounded by an annular sealing and the partition engages the annular sealing, at least when the lid is in a closed position; and wherein the annular sealing comprises an inner annular sealing member in sliding engagement with the flange and an outer flexible member providing for a non sliding engagement with the partition when the lid is in the closed position.

2. A centrifugal separator according to claim 1, wherein said distal edge constitutes said weir edge communicating with said second outlet opening.

3. A centrifugal separator according to claim 1, further comprising an outlet housing placed in the second rear longitudinal area, said outlet housing constituting part of said conduit, said outlet housing being rotatable around an adjustment axis, and said outlet housing comprising a side wall offset from the adjustment axis, the second outlet opening being placed in said side wall.

4. A centrifugal separator according to claim 3, wherein the conduit with the outlet housing is part of an outlet element having a connecting piece rotatably connected to the base.

5. A centrifugal separator according to claim 4, wherein the outlet element is tubular and has an axis coaxial with the adjustment axis.

6. A centrifugal separator according to claim 3, wherein the adjustment axis is parallel with the axis of rotation.

7. A centrifugal separator according to claim 1, wherein at least one of the weir edges extend in a plane, which is parallel with the base.

* * * * *